US006425142B2

(12) United States Patent
Sasaki et al.

(10) Patent No.: US 6,425,142 B2
(45) **Date of Patent: *Jul. 30, 2002**

(54) RETENTION MECHANISM FOR A HELMET

(75) Inventors: Steve Sasaki, Elk Grove; Kurt Workman, Santa Cruz; F. Robert Egger, Watsonville, all of CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/825,009

(22) Filed: Apr. 3, 2001

Related U.S. Application Data

(63) Continuation of application No. 09/525,997, filed on Mar. 15, 2000, now Pat. No. 6,226,802.

(51) Int. Cl.[7] ..... A42B 7/00
(52) U.S. Cl. ..... 2/421; 2/417; 2/425
(58) Field of Search ..... 2/417, 418, 419, 2/425, 421, 182.1, 183

(56) References Cited

U.S. PATENT DOCUMENTS

| | | | | |
|---|---|---|---|---|
| 2,769,176 | A | * | 11/1956 | Grancsay |
| 3,852,821 | A | | 12/1974 | Mickel |
| 5,042,093 | A | | 8/1991 | Legendre |
| 5,381,560 | A | | 1/1995 | Halstead |
| 5,572,749 | A | | 11/1996 | Ogden |
| 5,581,819 | A | * | 12/1996 | Garneau |
| 5,638,551 | A | | 6/1997 | Lallemand |
| 5,659,900 | A | | 8/1997 | Arney et al. |
| 5,774,901 | A | | 7/1998 | Minami |
| 5,794,272 | A | * | 8/1998 | Workman et al. |
| 5,915,537 | A | * | 6/1999 | Dallas et al. |
| 5,983,405 | A | * | 11/1999 | Casale |

FOREIGN PATENT DOCUMENTS

| | | |
|---|---|---|
| EP | 0 365 433 | 10/1989 |
| EP | 0 682 885 A1 | 9/1995 |
| EP | 0 832 572 A2 | 9/1997 |
| FR | 2 764 484 | 12/1997 |

* cited by examiner

*Primary Examiner*—Rodney M. Lindsey
(74) *Attorney, Agent, or Firm*—Knobbe Martens Olson & Bear, LLP

(57) ABSTRACT

An improved retention mechanism for a bicycle helmet is provided. A helmet including a retention mechanism comprises a shell for protecting a head of a person and a fit system elastically coupled to the shell. The fit system comprises a bowl designed to fit an occipital region of the person's head and a hinge for coupling the fit system to the shell, the hinge permitting the fit system to move. The fit system further including a spring element for positioning the bowl against the occipital region of the person's head, to stabilize the helmet against the person's head.

12 Claims, 8 Drawing Sheets

RETENTION MECHANISM FOR A HELMET

RELATED APPLICATIONS

This application is a continuation of Assignee's application Ser. No. 09/525,997, filed Mar. 15, 2000, titled AN IMPROVED RETENTION MECHANISM FOR A HELMET now U.S. Pat. No. 6,226,802.

FIELD OF THE INVENTION

The present invention relates to helmets, and more specifically, to retention mechanisms for helmets.

BACKGROUND

Helmets for head protection during bicycle riding falls and accidents have continuously evolved and undergone numerous improvements in recent years. One particular area of refinement has been in the retention mechanism to fit and stabilize the helmet on the bicycle rider's head. An example of a prior art bicycle helmet and a means for securing it from excessive movement is disclosed in U.S. Pat. No. 5,659,900.

In order to fit a people having different head shapes and sizes, helmets are often available in several sizes. The fit is customized to the rider's head by inserting or removing cushions and pads around the interior of the helmet.

Generally prior art helmets have not been shaped to fit the curvature beneath the occipital region of the rider's head to stabilize the helmet. One prior art solution that fits the curvature beneath the occipital region of the rider's head is disclosed in U.S. Pat. No. 5,659,900. In this prior art helmet, an inverted T-shaped articulated member was attached to a back portion of the bicycle helmet shell assembly. The articulated member has a lower distal end. An elastic means connects the T-shaped articulated member and opposite sides of the shell assembly for allowing the distal end of the articulated member to extend rearward when the helmet is donned to provide a resilient forward pressure against an inwardly curved portion on the posterior of a rider's head.

SUMMARY OF THE INVENTION

A retention mechanism for a helmet is described. A helmet including a retention mechanism comprises a shell for protecting a head of a person and a fit system elastically coupled to the shell. The fit system comprises a bowl designed to fit an occipital region of the person's head and a hinge for coupling the fit system to the shell, the hinge permitting the fit system to move. The fit system further including a spring element for positioning the bowl against the occipital region of the person's head, to stabilize the helmet against the person's head.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

An improved retention mechanism for a helmet is described. The retention mechanism provides an intuitive wearer interface, permitting tension adjustment while the helmet is worn. A single knob adjustment mechanism provides two-finger adjustment, for one embodiment. The helmet including the retention mechanism covers less head surface, providing maximum heat dissipation. The retention mechanism is relatively light-weight, and provides excellent support for the helmet. For one embodiment, the universal bowl shape of the retention mechanism fits most head shapes and sizes comfortably. For one embodiment, lower strap slots keep helmet straps from becoming tangled. In this way, the new retention mechanism, described in more detail below, provides many benefits to the wearer as well as to the manufacturer of the retention mechanism and helmet.

Figure 1:
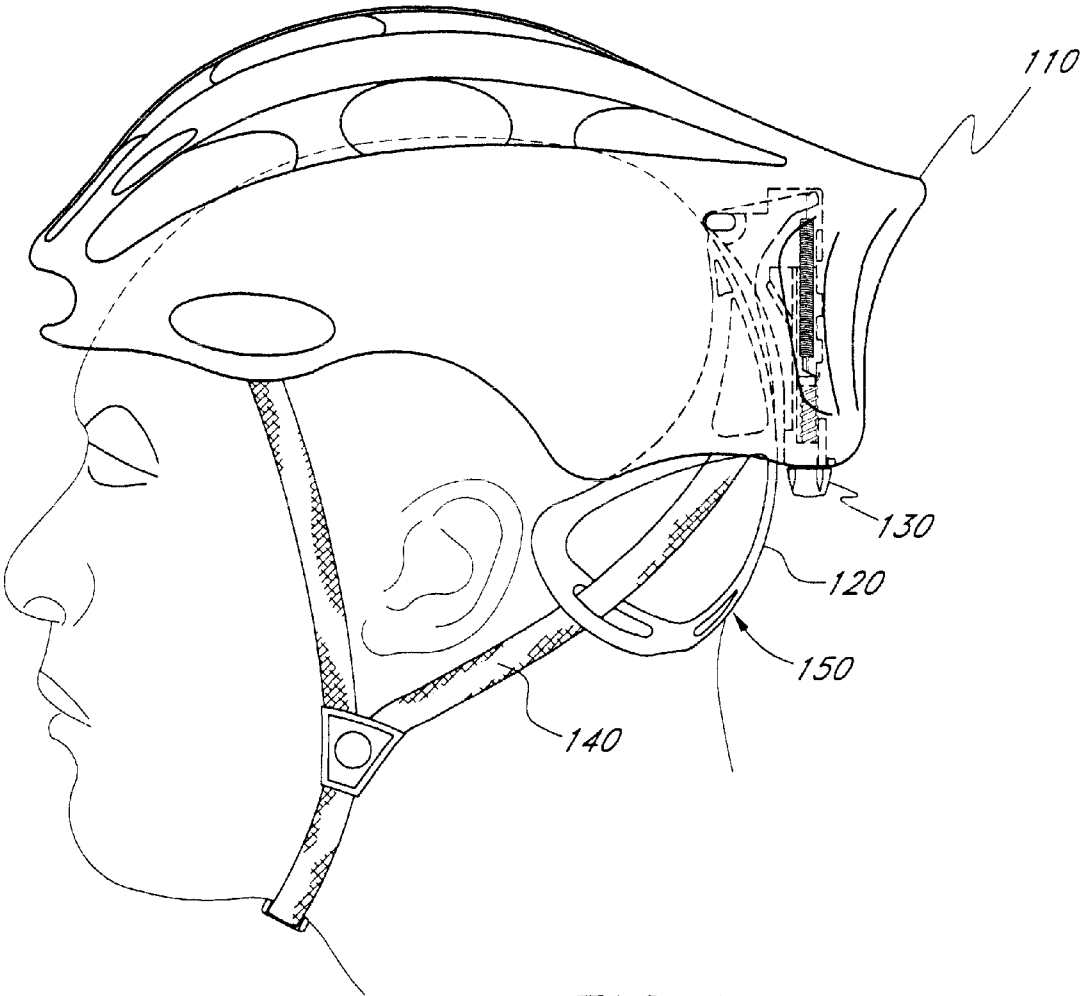
FIG. 1 is a side view of a wearer wearing a helmet including one embodiment of the retention mechanism according to the present invention.

FIG. 1 is a side view of a wearer wearing a helmet including one embodiment of the retention mechanism according to the present invention. FIG. 1 illustrates a side view of a helmet including the retention mechanism according to the present invention. The helmet 110 is designed to fit on the head of a wearer. The helmet 110 includes a retention mechanism 120, which is designed to fit on the back of the helmet 110.

The retention mechanism 120 attaches into the foam on the helmet 110. The retention mechanism 120 includes an adjustment mechanism 130, which permits a wearer to tighten or loosen the retention mechanism 120, while the helmet 110 is on the wearer's head. The retention mechanism 120 includes a bowl shaped portion 150, which is designed to fit the back of the head of the wearer.

The helmet 110 further includes a helmet strap 140. The helmet strap 140 is attached to the helmet 110 at the front, and to the retention mechanism 120 in the back. For one embodiment, the helmet strap 140 is threaded through the bowl shaped portion 150 of the of the retention mechanism 120, and is coupled to the back of the helmet 110. For one embodiment, this keeps the helmet straps 140 from becoming tangled.

The retention mechanism 120 and the helmet strap 140 together fix the helmet 110 to the wearer's head, such that the helmet should not slip. Because of the configuration of the bowl 150, sufficient airflow is provided to the wearer's head, to minimize discomfort.

Figure 2:
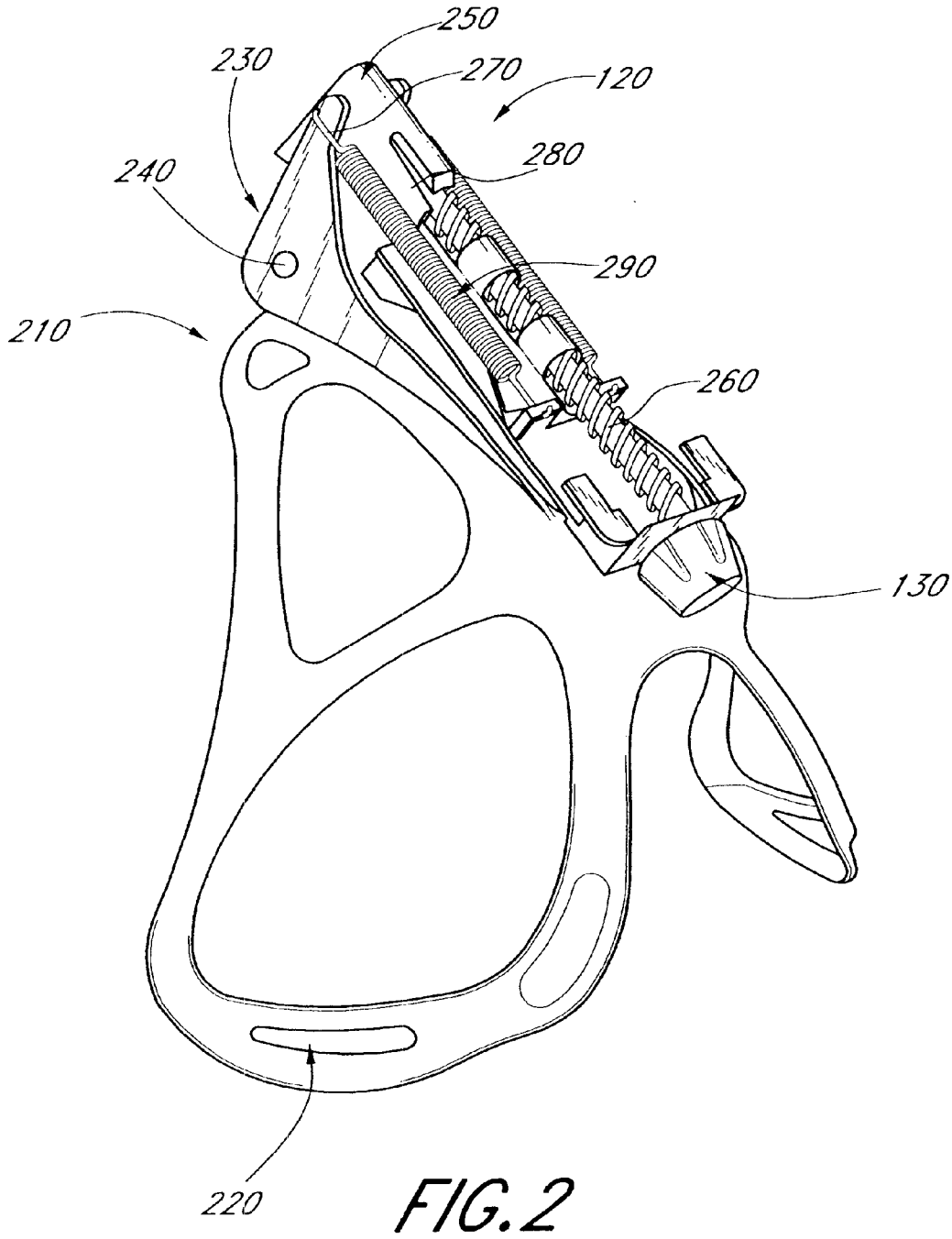
FIG. 2 is a perspective view of one embodiment of the retention mechanism.

FIG. 2 is a perspective view of one embodiment of the retention mechanism. The retention mechanism 120 includes a spine 250 that is designed to be attached to the helmet (not shown). The spine 250, for one embodiment is nylon. Alternatively, the spine 250 may be any other rigid material that provides sufficient support for the bowl 210.

A moving element 230 is coupled to the spine 250 by a hinge (not shown). For one embodiment, the moving element 230 and the hinge are nylon, to provide rigidity and support. Alternative materials may be used. A light-weight but rigid material is preferred. The moving element 230 is designed to hingedly move the bowl 210 between various positions. As described below, the elastic elements 290 tension the moving element 230, such that movement of the hinge is made easier and/or harder, depending on the tension provided by the elastic elements 290.

The retention mechanism 120 has a bowl 210 designed to fit the head of a wearer. For one embodiment, the bowl 210 is nylon, or another relatively rigid and easily formed material. The shape of the bowl 210 is designed to fit a variety of head shapes. For one embodiment, the bowl 210 includes a plurality of slots 220. For one embodiment, at least one of the slots 220 is designed to have a helmet strap (not shown) threaded through the slot 220.

The retention mechanism 120 includes adjustment mechanism 130. For one embodiment, the adjustment mechanism 130 is a knob. In an alternative embodiment, the adjustment mechanism 130 may be another shape designed to be grasped by a wearer. For one embodiment, the adjustment mechanism 130 is made of thermoplastic polyurethane. Alternatively, the adjustment mechanism may be made of other materials—such as other plastics, rubbers, or metals—that are relatively rigid, and are not slippery, providing a grip for the wearer to adjust the knob.

The adjustment mechanism 130 is designed to control an adjustor 260. The adjustor 260 is a screw, for one embodiment. The adjustor 260 is controlled by the adjustment mechanism 130. For another embodiment, the adjustor 260 may be a ratchet, a pulling mechanism with multiple stops. For yet another embodiment, the adjustor 260 may be a slot/groove configuration, or any other mechanism that can adjust the elastic materials 290 providing tension in the retention mechanism 120. For one embodiment, if the adjustor 260 is a screw, a holder 280 fixes the screw 260 in place, such that when the screw 260 is turned, the adjustment mechanism 130 does not move vertically, but the elastic materials 290 move vertically.

The elastic materials 290 tension the retention mechanism 120 against the wearer's head. For one embodiment, the elastic materials 290 are springs. For another embodiment, the elastic materials may be rubber, or any other material that can provide adjustable elasticity.

Figure 3:
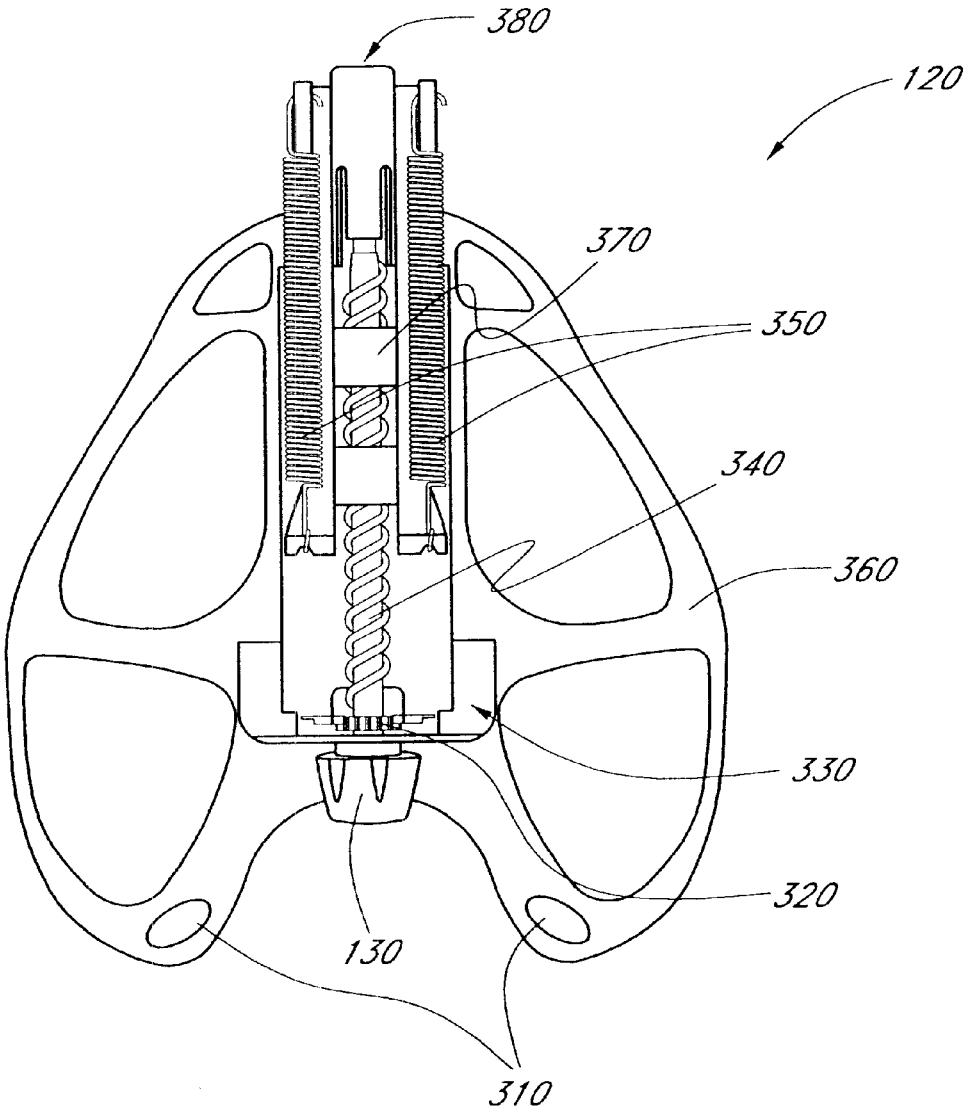
FIG. 3 is a front view of one embodiment of the retention mechanism.

FIG. 3 is a front view of one embodiment of the retention mechanism. The spine 380 is rigid, and defines the center of the retention mechanism. The spine 380 attaches the retention mechanism 120 to the helmet (not shown).

Elastic elements 350 are attached to the spine on one side, and to the nut 370 on the other side. The nut 370 is moved by the screw 340, such that when a wearer uses the knob 130 to tighten the screw 340, the elastic elements 350 are stretched, providing more resistance to the hinge (not shown).

For one embodiment, the screw 340 includes a ratchet 320 at its base, such that the screw 340 does not release, except if a wearer turns the knob 130.

The bowl 360 is shaped with multiple holes, for airflow. The shape of the bowl 360, for one embodiment, is optimized to fit multiple head shapes and head sizes. The bowl, for one embodiment, may include reflector decals 310 for additional safety, and to identify the retention mechanism 120.

Figure 4A:
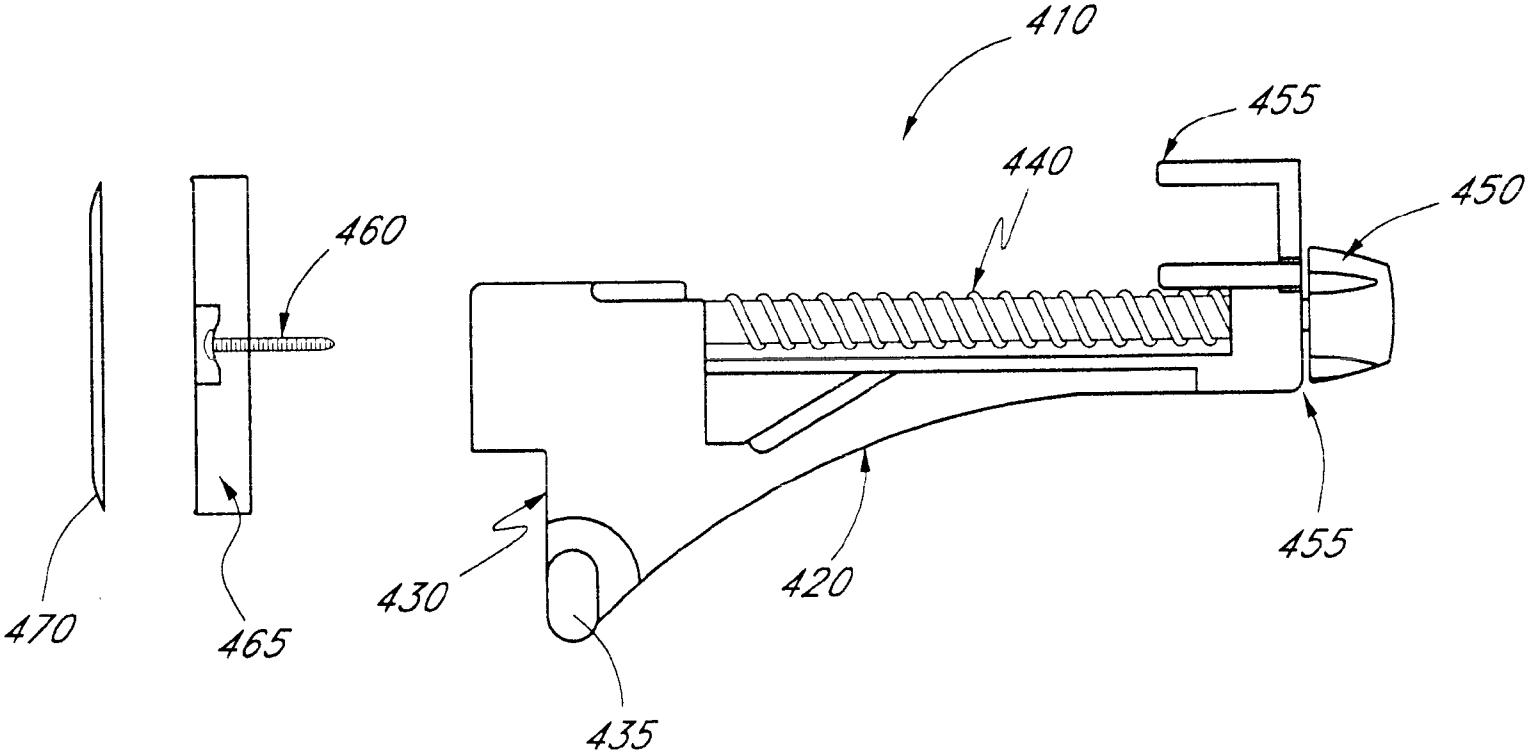
FIG. 4A is a view of one embodiment of the screw mechanism for the retention mechanism.

FIG. 4 is a view of one embodiment of the spine, adjustor, and adjustment mechanism for the retention mechanism. The spine 430 is shaped to receive a screw 460 that is used to attach the retention mechanism to the helmet. For one embodiment, the screw 460 is attached through a washer 465, which is shaped to fit the top of the helmet (not shown). For one embodiment, a coverlet 470 is designed to fit over the washer 465. For one embodiment, the coverlet 470 is designed such that it does not interrupt the airflow over the helmet. For one embodiment, the coverlet 470 is designed of the same material as the cover of the helmet. For one embodiment, the helmet is made of foam, and covered with a plastic material. For one embodiment, the coverlet 470 is made of the same type of plastic material.

For one embodiment, the screw 460 may be screwed into the helmet at multiple angles. In this way, the angle of the spine, and thus the retention mechanism, may be adjusted. For one embodiment, this adjustment may be done by the wearer.

The spine 430 includes a hinge 435, designed to receive the bowl (not shown). The side of the spine 420 is shaped to follow the contour of the bowl.

For one embodiment, the screw 440 is designed to turn to tighten the elastic elements (not shown). For one embodiment, the screw 440 is fixed such that it does not extend further from the spine, when it is turned.

Figure 4B:
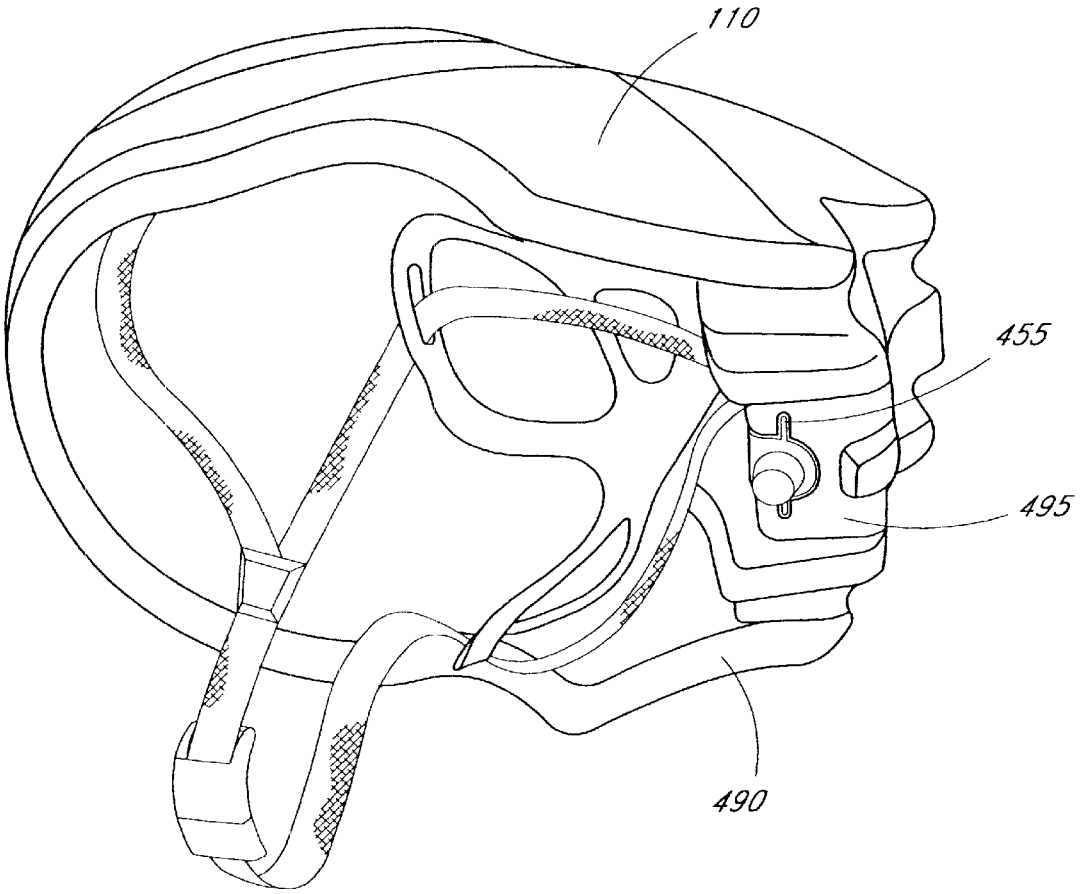
FIG. 4B illustrates a bottom view of the helmet including the retention mechanism.

The spine may further include a tooth 455, designed to further secure the retention mechanism into the helmet. The tooth 455, for one embodiment, extends the same length as the wings. FIG. 4B illustrates a bottom view of the helmet including the retention mechanism. As can be seen, the teeth 455 are secured directly into the foam 495 of the bottom 490 of the helmet. FIG.

Figure 5A:
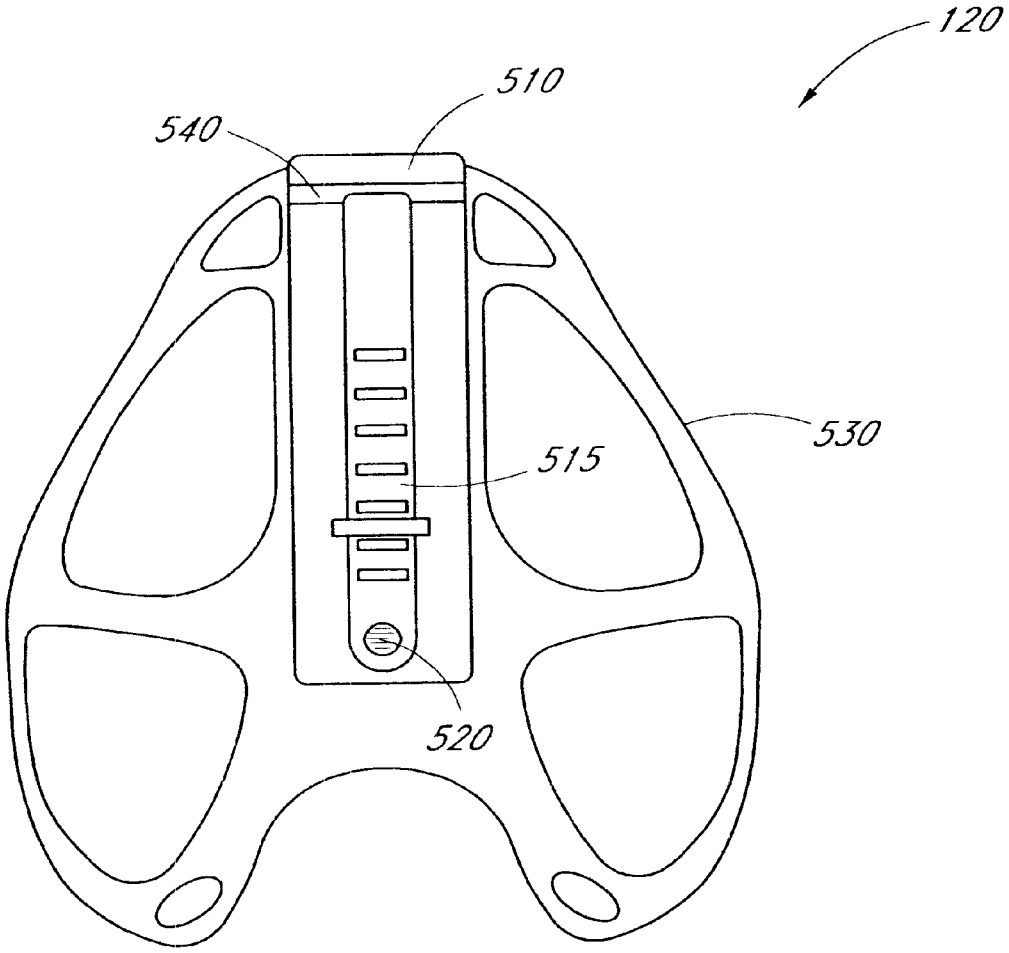
FIG. 5A is one embodiment of an alternative retention mechanism.

FIG. 5A is one embodiment of an alternative retention mechanism. The spine 510 supports the retention mechanism, and is used to attach the retention mechanism to a helmet (not shown). For one embodiment, the spine includes a location for a screw at its top, and a location for a hook or similar device at its bottom, to firmly attach the retention mechanism 120 to the helmet.

The retention mechanism 120 further includes an elastic element 515, adjusted by adjustment element 520. For one embodiment, the elastic element 515 is a rubber or similar material, with a relatively high elasticity and adjustable resistance. The wearer can pull on adjustment element 520, which is a finger-grip for one embodiment. By setting the elastic element 515 at different extensions, the resistance provided by the elastic element is increased. The elastic element 515 is coupled to the hinge (not shown) at the top 540, such that as the resistance provided by the elastic element is increased, the ease of movement of the hinge is lowered. This provides stronger or weaker support for the wearer, based on the wearer's adjustment.

The retention mechanism 520 further includes a bowl 530. For one embodiment, the bowl 530 includes a plurality of cut-outs. The cut-outs are shaped to maximize airflow over the wearer's head, yet provide enough support to stabilize the helmet. Furthermore, the bowl 530 must have sufficient rigidity, even including the cut-outs, to provide stable support.

Figure 5B:
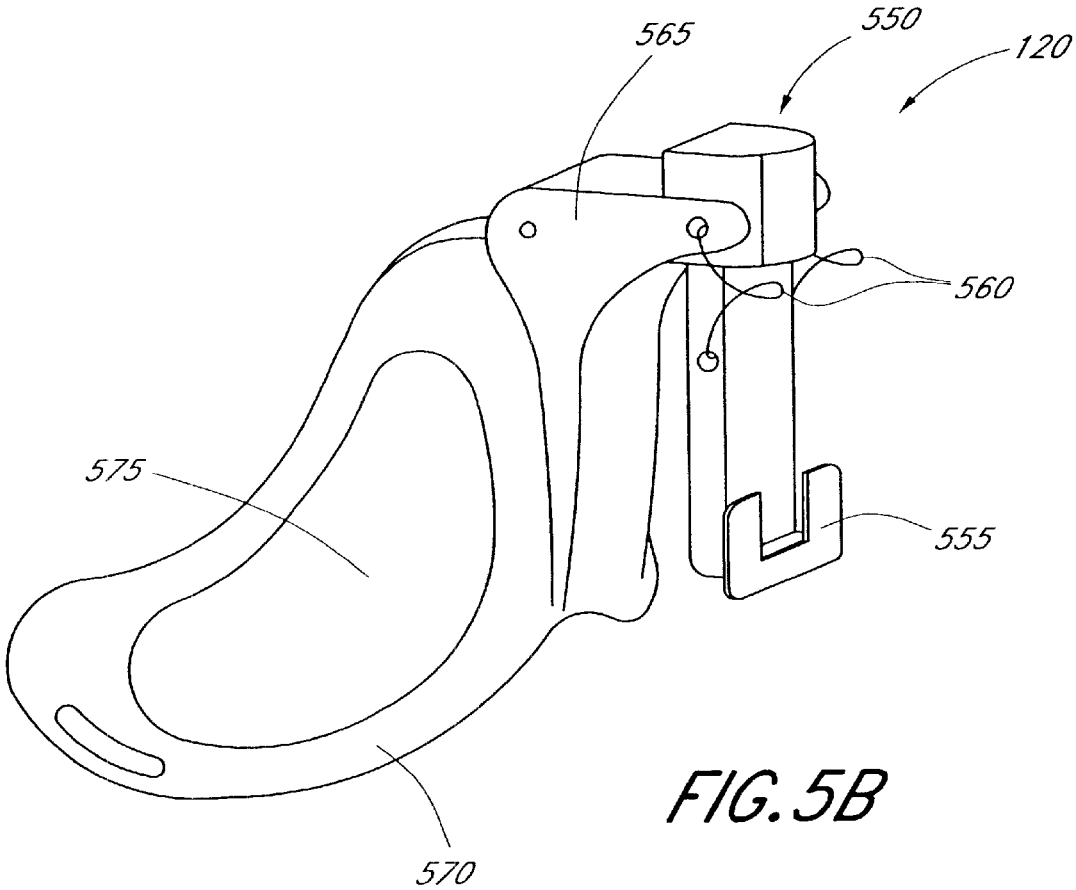
FIG. 5B is yet another embodiment of an alternative retention mechanism.

FIG. 5B is another embodiment of an alternative retention mechanism. The spine 550 is designed to be attached to the helmet (not shown) at the top, as well as at the bottom. For one embodiment, teeth 555 are designed to grip into the foam of the helmet when the retention mechanism 120 is in the helmet.

The retention mechanism 120 includes elastic elements 560 which provide resistance to hinge 565. The hinge 565 is coupled to a bowl 570. The bowl is designed to fit the back of a wearer's head. The elastic element 560 provides a steady resistance, permitting a wearer to place the helmet on his or her head, but forcing the bowl 570 against the wearer's head. The bowl 570 may include a cut-out 575, to improve airflow over the wearer's head. The configuration of the cut-out 575 is arbitrary, but is generally designed to optimize airflow while providing stability to the bowl 570, and thus to the retention mechanism on the wearer's head.

Figure 6:
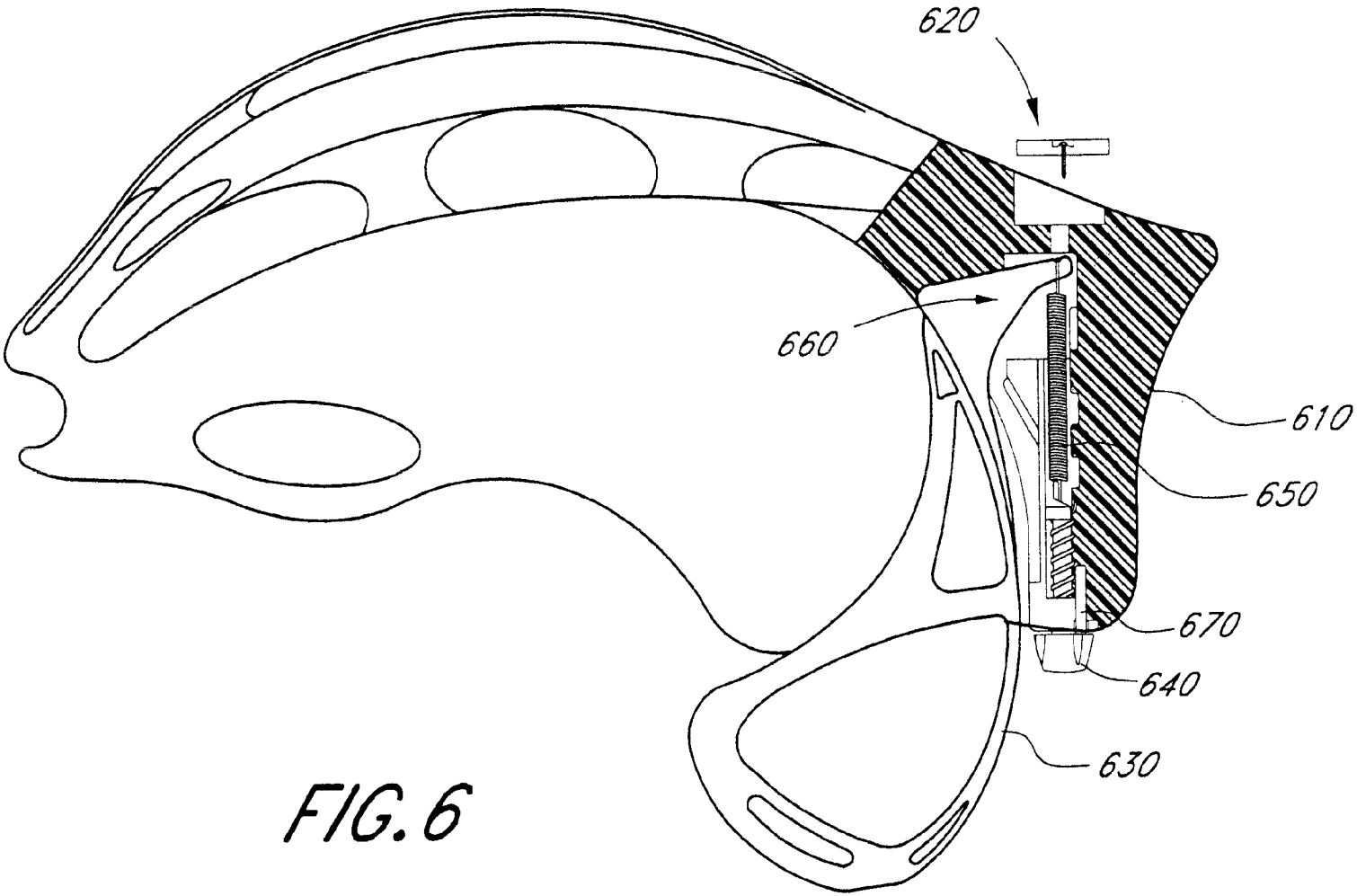
FIG. 6 is a cut-away view of one embodiment of the back of a helmet including one embodiment of the retention mechanism.

FIG. 6 is a cut-away view of one embodiment of the back of a helmet including one embodiment of the retention mechanism. The retention mechanism 120 is fastened to the helmet by a screw 625 and a molded washer 620. The molded washer 620 is designed to fit into the helmet. For one embodiment, the molded washer 620 is shaped to fit into a hole in the helmet, such that the aerodynamic qualities of the helmet are not changed.

The retention mechanism 120 further includes an adjustment device 650, to change the tension of the retention device. The adjustment device 650 is controlled by knob 640. For one embodiment, a tooth 670 further attaches the retention device 120 into the helmet 610.

FIGS. 1–6 have shown various elastic element configurations, some of which were configurable while others were non-configurable and provide a steady resistance. It is to be understood that alternative elastic elements may be used. The elastic elements may be adjustable in various ways, including a screw, a ratchet, an elastic band, or other adjusting means. The elastic elements may be non-adjustable, in the alternative. It is to be understood that other types of elastic elements may be used to provide resistance of the bowl against a wearer's head.

The configuration of the cut-outs in the bowl may be varied as well. For one embodiment, no cut-outs may be. present, small cut-outs may be present, or various configurations of larger and/or smaller cut-outs may be present.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A bicycle helmet for placement on the head of a wearer, comprising:

a shell;

a hinge fixed with respect to said shell; and a head-clasp connected to said hinge so as to be rotatable about a first axis generally perpendicular to a longitudinal axis of said shell;

wherein said head-clasp comprises a bowl which is biased to rotate toward the head of the wearer;

wherein said head-clasp forms a leverage point angularly displaced from said bowl about said first axis, and said helmet further comprises a biasing means operatively coupled to said leverage point and biasing said head-clasp toward the head of the wearer.

2. The helmet of claim 1, wherein said head-clasp and said shell cooperate grip the head of the wearer.

3. The helmet of claim 1, wherein said biasing means comprises an adjustable biasing means operatively coupled to said leverage point and adjustably biasing said head-clasp toward the head of the wearer.

4. A bicycle helmet for placement on the head of a wearer, comprising:

a shell;

a hinge fixed with respect to said shell; and a head-clasp connected to said hinge so as to be rotatable about a first axis generally perpendicular to a longitudinal axis of said shell;

wherein said head-clasp is biased to rotate toward the head of the wearer; said helmet further comprising an elastic element that biases said head-clasp toward the head of the wearer.

5. The helmet of claim 4, wherein said head-clasp comprises a bowl and a leverage point angularly displaced from said bowl about said first axis, and said elastic element has a first end connected to said leverage point and second end connected to an anchor point.

6. The helmet of claim 5, wherein said anchor point is moveable with respect to said leverage point to adjust a biasing force exerted by said elastic element.

7. A bicycle helmet for placement on the head of a wearer, comprising:

a shell;

a hinge attached to said shell; and means for grasping the head of the wearer, said means for grasping being connected to said hinge so as to be pivotable about an axis generally perpendicular to a longitudinal axis of said shell;

wherein said means for grasping is biased to pivot toward the head of the wearer and said means for grasping is biased by at least one elastic element operatively coupled to said means for grasping.

8. The helmet of claim 7, herein said elastic element has a first end operatively coupled to said means for grasping and a second end connected to an anchor point, and said anchor point is moveable so as to adjust a biasing force applied by said elastic element.

9. A method of securing a bicycle helmet to the head of a wearer, the method comprising:

mounting a hinge in a shell of said helmet;

attaching a bowl to said hinge so that said bowl is pivotable fore-and-aft with respect to said shell within a range of motion that includes a forward-pivoted position; and biasing said bowl toward said forward-pivoted position so that the head of the wearer is gripped by said bowl and said shell, wherein the step of biasing said bowl comprises coupling at least one elastic member to said bowl so that motion of said bowl away from said forward-pivoted position tends to elongate said elastic member.

10. The method of claim 9, wherein said elastic member has a first end in fixed relation to said bowl and a second end connected to an anchor point of said bowl, and the step of biasing said bowl further comprises adjustably biasing said bowl by moving said anchor point with respect to said first end of said elastic member.

11. A self-adjusting helmet, comprising:

a shell having a front end and a back end;

a first portion defining a surface shaped to fit against an occipital region of a person's head, said first portion being coupled to said shell and rotatable with respect to said shell about a first axis; and a biaser connected to said first portion at a first end of said biaser and biasing said surface of said first portion about said first axis toward said front of said shell;

wherein said first end of said biaser moves a first distance to cause said surface to move a second distance about said first axis, and said second distance is greater than said first distance; and wherein said first end of said biaser is connected to said first portion at an arm defined by said first portion, and said biaser urges said arm downward to cause said surface to move toward the front of said helmet.

12. The helmet of claim 11, wherein said biaser is connected to said arm on a side of said first axis opposite said surface.

* * * * *